US012566000B2

(12) United States Patent
Huester et al.

(10) Patent No.: US 12,566,000 B2
(45) Date of Patent: Mar. 3, 2026

(54) DOWNDRAFT VENTILATOR, COOKING SYSTEM, AND METHOD FOR INSTALLATION

(71) Applicant: Miele & Cie. KG, Guetersloh (DE)

(72) Inventors: Ingo Huester, Arnsberg (DE); Ole Behrens, Arnsberg (DE); Harry Hopfauf, Soest (DE)

(73) Assignee: MIELE & CIE. KG, Guetersloh (DE)

( * ) Notice: Subject to any disclaimer, the term of this patent is extended or adjusted under 35 U.S.C. 154(b) by 518 days.

(21) Appl. No.: 18/171,682

(22) Filed: Feb. 21, 2023

(65) Prior Publication Data

US 2023/0266018 A1 Aug. 24, 2023

(30) Foreign Application Priority Data

Feb. 23, 2022 (BE) ..... 2022/5123

(51) Int. Cl.
*F24C 15/20* (2006.01)

(52) U.S. Cl.
CPC ..... *F24C 15/2042* (2013.01); *F24C 15/2071* (2013.01); *F24C 15/2085* (2013.01)

(58) Field of Classification Search
CPC . A47B 2077/025; A47B 77/022; F24C 15/30; E04F 13/076
See application file for complete search history.

(56) References Cited

U.S. PATENT DOCUMENTS 4,945,891 A 8/1990 Cecil
5,062,410 A * 11/1991 Sarnosky ..... F24C 15/2092 126/299 R
2006/0278215 A1* 12/2006 Gagas ..... F24C 15/2092 126/299 D
2010/0065038 A1* 3/2010 Davies ..... F24C 15/2042 126/299 D
2010/0230563 A1* 9/2010 Flynn ..... A47K 1/05 29/525.01
2014/0034040 A1* 2/2014 Sinur ..... F24C 15/2092 126/299 D

FOREIGN PATENT DOCUMENTS

EP 2762786 A1 * 8/2014 ..... F24C 15/10
EP 3677843 A1 7/2020
EP 4036480 A2 8/2022
GB 990117 A * 4/1965 ..... E03C 1/33

* cited by examiner

*Primary Examiner* — Jorge A Pereiro

(74) *Attorney, Agent, or Firm* — Leydig, Voit & Mayer, Ltd.

(57) ABSTRACT

A downdraft ventilator includes: at least one housing device for installation into least one cabinet body below at least one countertop; at least one vapor-collecting hood device having at least one intake opening for cooking vapors, and, when installed, the at least one vapor-collecting hood device at least partially extends through at least one opening in a countertop; at least one mounting frame fittable into an opening of the countertop, the at least one mounting frame having at least one opening for the vapor-collecting hood device; and at least one supporting device having at least one supporting element, the at least one supporting device being mounted on the at least one housing device, and the at least one supporting element causing the at least one mounting frame and/or a cooktop device disposed adjacent thereto to be supported at least in some portions.

10 Claims, 3 Drawing Sheets

DOWNDRAFT VENTILATOR, COOKING SYSTEM, AND METHOD FOR INSTALLATION

CROSS-REFERENCE TO PRIOR APPLICATION

Priority is claimed to Belgian Patent Application No. BE 2022/5123, filed on Feb. 23, 2022, the entire disclosure of which is hereby incorporated by reference herein.

FIELD

The present invention relates to an exhaust ventilation system or downdraft ventilator including at least one housing device, at least one vapor-collecting hood device, and at least one mounting frame. The housing device is intended for installation into at least one cabinet body below at least one countertop, and the vapor-collecting hood device has at least one intake opening for cooking vapors, and, when installed, the vapor-collecting hood device extends at least partially through at least one opening in the countertop. The mounting frame is fitted into an opening of the countertop and has at least one opening for the vapor-collecting hood device. The present invention also relates to a cooking system including at least one countertop, at least one cabinet body, at least one cooktop device, and at least one such downdraft ventilator. The present invention further relates to a method for installing such a cooking system.

BACKGROUND

Exhaust hoods and downdraft ventilators are often installed above a cooktop or around a cooktop in order to exhaust greasy cooking vapors that rise during cooking, and to thereby prevent soiling of the kitchen elements and the development of unpleasant odors. To this end, in the case of downdraft ventilators, which are normally integrated substantially flush into a countertop and/or a cooktop, the greasy cooking vapors rising above the cooktop are typically drawn into an intake opening, freed from grease constituents and odors, and carried away downward, in particular below the countertop or cooktop, by means of a fan device.

The functional components of a downdraft ventilator, such as the filter devices, the fan device, and/or the housing are typically accommodated in or integrated into a space below the countertop, in particular in a piece of kitchen furniture or the like. Therefore, unlike classical exhaust hoods, downdraft ventilators require substantially no mounting space above the cooktop and thus allow for a kitchen furniture design that is often perceived as particularly appealing to the eye.

In the prior art, when a downdraft ventilator is integrated into a countertop next to or behind a cooktop, the countertop is provided with two cutouts or openings therein, which are matched in size to the downdraft ventilator and the cooktop. Since it is desired or required for the downdraft ventilator, or for the mounting frame of the downdraft ventilator, and the cooktop to be supported all around, two separate cutouts are made in the countertop, which are separated by a remaining strip of the countertop. In order to ensure sufficient stability and to avoid defects during the creation of the cutouts, such strips typically have a width of at least 30 mm.

This strip then serves as a supporting seat for the mounting frame of the downdraft ventilator and the cooktop at the adjacent side. Without such a strip, the cooktop and the mounting frame of the downdraft ventilator could yield downwardly under load, thereby causing a defect. Especially in the case of very wide cooktops, a strip of greater width may be advantageous or even required to ensure sufficient stability.

However, the requirement for the strip has the disadvantage that the cutouts have to be made very carefully in order that the strip remains at the correct position and does not break. In such case, the countertop would have to be replaced.

Moreover, the strip does not allow for flush installation of the downdraft ventilator and the cooktop because the strip remains visible to the eye. However, customers often desire that the downdraft ventilator and the cooktop be installed immediately. In addition, if the downdraft ventilator and the cooktop are mounted flush with each other; i.e., directly contiguous to each other, the intake opening for cooking vapors is disposed closer to the cooktop, which is advantageous.

SUMMARY

In an embodiment, the present invention provides a downdraft ventilator, comprising: at least one housing device for installation into least one cabinet body below at least one countertop; at least one vapor-collecting hood device having at least one intake opening for cooking vapors, and, when installed, the at least one vapor-collecting hood device at least partially extends through at least one opening in a countertop; at least one mounting frame fittable into an opening of the countertop, the at least one mounting frame having at least one opening for the vapor-collecting hood device; and at least one supporting device having at least one supporting element, the at least one supporting device being mounted on the at least one housing device, and the at least one supporting element being configured to cause the at least one mounting frame and/or a cooktop device disposed adjacent thereto to be supported at least in some portions, the at least one supporting device including at least one height adjustment device.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
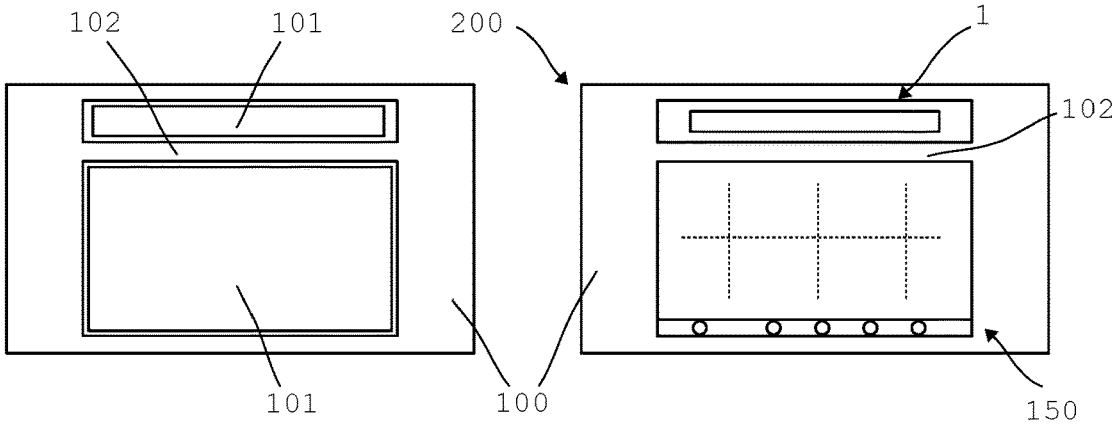
FIG. 1 shows purely schematically, in two top views, a cooking system including a downdraft ventilator and a cooktop device in a countertop in accordance with the prior art.

In an embodiment, the present invention provides a way of installing a downdraft ventilator and a cooktop into a countertop in a stable manner and such that they are flush with each other; i.e., adjacent to each other with no space therebetween.

The downdraft ventilator according to the invention includes at least one housing device, at least one vapor-collecting hood device, and at least one mounting frame. The housing device is intended for installation into at least one cabinet body below at least one countertop. The vapor-collecting hood device has at least one intake opening for cooking vapors, and, when installed, the vapor-collecting hood device at least partially extends through at least one opening in a countertop. The mounting frame is provided for fitting into an opening of the countertop, the mounting frame having at least one opening for the vapor-collecting hood device. Further provided is at least one supporting device having at least one supporting element, the supporting device being mounted on the housing device. The supporting element causes the mounting frame and/or a cooktop device disposed adjacent thereto to be supported at least in some portions.

In particular, the supporting element supports the mounting frame of the downdraft ventilator and the cooktop device.

The housing device serves in particular for the installation of the downdraft ventilator into a cabinet body below a countertop, the housing device in particular having disposed therein at least one fan device and/or at least one air exhaust passage. The housing device is preferably relatively flat in construction, so that sufficient stowing space and/or mounting space is left available in the front region of the cabinet body.

Depending on the particular design, a supporting device may be provided that supports, for example, a side of a mounting frame of the downdraft ventilator and/or a side of the cooktop device at least in some portions. However, depending on the particular design, it is also possible that a plurality of supporting devices may be provided at one side. Furthermore, depending on the particular design, it is also possible that supporting devices may be provided at different sides to provide support also at other sides by at least one supporting element.

The downdraft ventilator according to the invention offers many advantages. For example, the inventive design with a supporting device mounted on the housing device allows the cooktop and the downdraft ventilator to be mounted flush with each other. This is achieved because the otherwise required strip in the countertop can be dispensed with since a supporting device can occur at the adjacent sides of the downdraft ventilator and the cooktop device by the supporting element of the supporting device, the supporting device or the supporting element being supported on the housing device of the downdraft ventilator.

Moreover, a particularly easy installation is possible because the supporting device can be easily attached to the housing without a major installation effort or is pre-mounted in advance. In particular, it is possible to provide a single cutout in the countertop, which greatly simplifies installation.

In the prior art, mounting strips have been described for other applications, but some of them are complex to install because they are screwed at least to the built-in closet.

Preferably, the vapor-collecting hood device is at least partially movable. During such movement, the vapor-collecting hood device moves upwardly out of the countertop in particular through the opening in the mounting frame in order to bring the intake opening of the vapor-collecting hood device closer to the cooking vapors rising from the cooktop device during the operation of the downdraft ventilator.

In accordance with the invention, the supporting device includes at least one height adjustment device. A height adjustment device makes it possible, in particular, to optimally adapt or adjust the supporting element to the supporting height of the mounting frame and/or of the cooktop device. Such a height adjustment device may in particular be provided by, for example, at least two relatively movable sheet metal elements.

In advantageous embodiments, the height adjustment device includes at least one adjusting screw, at least one elongated slot, and/or at least one eccentric cam. Thus, the height of the supporting element can be optimally adapted to the supporting height of the mounting frame and/or of the cooktop device on the countertop or in a circumferential milled recess or groove in the opening of the countertop, for example, by using at least one adjusting screw, preferably two adjusting screws. Elongated slots can also be conveniently used here to provide the supporting element at an optimum height. The same applies to the use of an eccentric cam. Preferably, the individual variants can also be combined. For example, the height can be adjusted using one or more adjusting screws, the supporting element being moved in an elongated slot in the process.

One aspect is that the supporting element is perforated and/or has predetermined fracture points. This allows the supporting element to be adjusted in length by, in particular manually, severing portions therefrom.

Preferred embodiments provide that the length of the supporting element be adjustable. Depending on the embodiment, the supporting element may be provided with excess length to ensure that it can be used independently of the width of the cutout in a countertop. However, depending on the particular design, the supporting element may also be telescopic or may be made of multiple parts so that, for example, extensions are provided which can be attached or otherwise connected to the supporting element as needed.

Preferably, the supporting element is provided by at least one sheet metal element. Thus, a stable and functional supporting device can be provided using simple components.

Preferably, the supporting element includes at least one bearing portion which is substantially L-shaped and/or T-shaped at least in some portions. By configuring the bearing portion of the supporting element in this way, it is possible to provide a sufficiently large bearing surface for a mounting frame of the downdraft ventilator and/or a cooktop device.

The inventive cooking system includes at least one countertop, at least one cabinet body, at least one cooktop device, and at least one downdraft ventilator such as has been described hereinabove. At least the housing device of the downdraft ventilator is disposed in the cabinet body. Furthermore, a common opening for the vapor-collecting hood device of the downdraft ventilator and for the cooktop device is provided in the countertop. At least some portions of the mounting frame of the downdraft ventilator and/or of the cooktop device rest on the supporting element of the supporting device.

In particular, the supporting element supports the mounting frame of the downdraft ventilator and the cooktop device.

Depending on whether provision is made for flush installation of the mounting frame and the cooktop device, the opening may have a circumferential milled recess or groove or rabbet, in which case the height of the supporting element are then optimally adjusted to the respective supporting height, for example, the top surface of the countertop or the supporting seat on the circumferential milled recess.

The cabinet body is disposed in particular below the countertop, the opening being disposed in particular in the region of the cabinet body in such a way that there is sufficient mounting space for the cooktop device and for the vapor-collecting hood device to extend or move therethrough.

The inventive cooking system also offers the advantages that were described above with reference to the downdraft ventilator according to the invention.

Preferably, the mounting frame and the cooktop device are disposed flush against each other. This is a significant advantage because no strip is needed in the countertop for placing thereon or supporting the mounting frame of the downdraft ventilator and the cooktop device. The supporting device mounted on the housing device allows this otherwise common strip to be dispensed with, and therefore allows the downdraft ventilator and the suitcase device to be installed flush against each other, which provides a particularly appealing appearance and additional advantages.

The method according to the invention is suitable for installing a cooking system such as has been described hereinabove. In this method, a common opening for the vapor-collecting hood device of the downdraft ventilator and for the cooktop device is formed in a countertop. The housing device of the downdraft ventilator is installed in the cabinet body, and the supporting device is disposed or mounted on the housing device. This is followed by the installation of the mounting frame of the downdraft ventilator and of the cooktop device, all aforementioned steps being carried out in a suitable order.

Thus, for example, the installation of the supporting device may be done prior to installing the housing device in the cabinet body. In this connection, a suitable variant can be selected depending on the particular design and the space available during installation.

Preferably, the mounting frame of the downdraft ventilator and the cooktop device are disposed flush against each other. This makes it possible to achieve a particularly appealing, flush and continuous appearance in particular of the cooktop device and the downdraft ventilator.

In accordance with the invention, the height of the supporting element is adjusted by means of the height adjustment device. Thus, the height can be adjusted in particular to the remaining bearing surface of the mounting frame and the cooktop device; i.e., the top surface of the countertop or, in the case of flush-mounted installation, to the supporting height of the milled recess that surrounds the opening in the countertop.

In advantageous refinements, the length of the supporting element is adjusted in particular prior to installing the mounting frame of the downdraft ventilator and/or the cooktop device. In this connection, it is preferred that the mounting frame and the cooktop device be supported substantially all around, so provision is made for the supporting element to have in particular a maximum possible length.

In FIG. 1, there is shown purely schematically in two top views the installation of a cooking system 200 including a cooktop device 50 and a downdraft ventilator 1, which are integrated into a countertop 100 in side-by-side relationship in accordance with the prior art.

The view on the left illustrates purely schematically that in the prior art, two separate cutouts or openings 101 are formed in countertop 100, into which openings downdraft ventilator 1 and cooktop device 50 are then installed.

What is important is that downdraft ventilator 100, or an installation frame, and cooktop device 50 be supported all around. In the prior art, to allow support to be provided on all sides, a strip 102 is provided between the two opening 101 in countertop 100, the strip 102 typically having a width of at least 30 mm to ensure sufficient stability for supporting cooktop device 50 and downdraft ventilator 1 or components thereof.

As can be seen in the view on the right, this does not allow for flush; i.e., gap-free installation of downdraft ventilator 1 and cooktop device 50. The strip 102 in the countertop between downdraft ventilator 1 and cooktop device 50 is always visible.

Apart from the fact some users desire that the downdraft ventilator and the cooktop device be mounted flush; i.e., immediately adjacent to each other, it is also technically advantageous to mount downdraft ventilator 1 directly adjacent to cooktop device 50 because this allows the intake opening 4 of a vapor-collecting hood device 3 of downdraft ventilator 1 to be disposed closer to the rising cooking vapors.

Moreover, making two cutouts or opening 101 in countertop 100 is technically more complex because the requirement for a relatively narrow strip 102 requires very precise working to ensure a visually appealing result and sufficient stability of strip 102.

Figure 2:
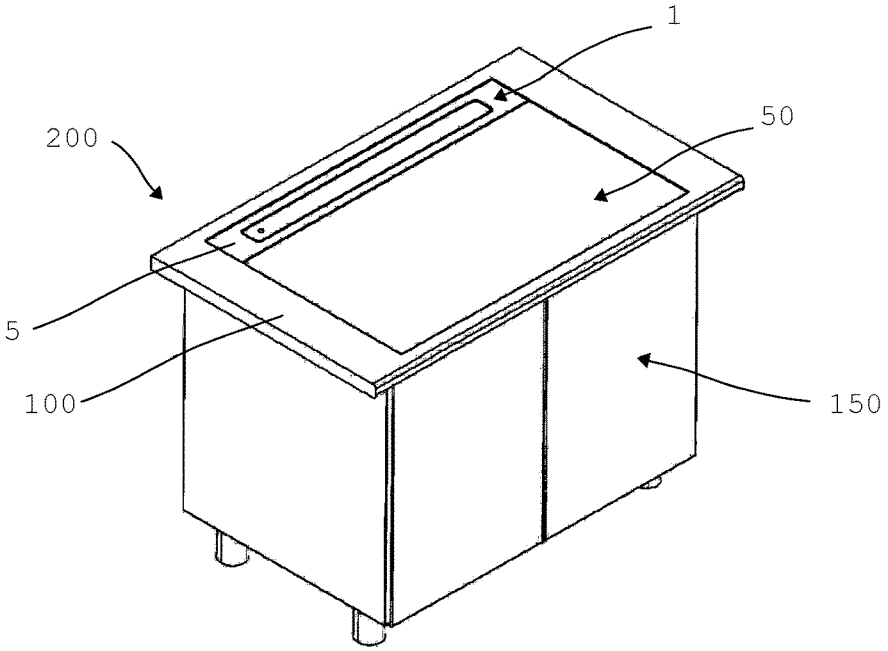
FIG. 2 shows purely schematically, in a perspective view, an exemplary embodiment of an inventive cooking system including an inventive downdraft ventilator and a cooktop device.

In FIG. 2, an inventive downdraft ventilator 1 in an inventive cooking system 200 is shown purely schematically in a purely schematic, oblique perspective top view. The inventive cooking system 200 includes a countertop 100, which in the exemplary embodiment shown here, rests on a cabinet body 150. Furthermore, countertop 100 has formed therein a common opening 101 in which the inventive downdraft ventilator or vapor-collecting hood device 3 or mounting frame 5 and cooktop device 50 are disposed flush side by side.

The inventive cooking system 200 and the inventive downdraft ventilator 1 make it possible for downdraft ventilator 1 and cooktop device 50 to be installed immediately; i.e., flush with each other in a countertop 100. In addition, a common opening 101, which is shown in more detail in the following figures, facilitates installation because it eliminates the need to laboriously make two cutouts or openings 101, leaving an accurately formed strip 102 therebetween.

Figure 3:
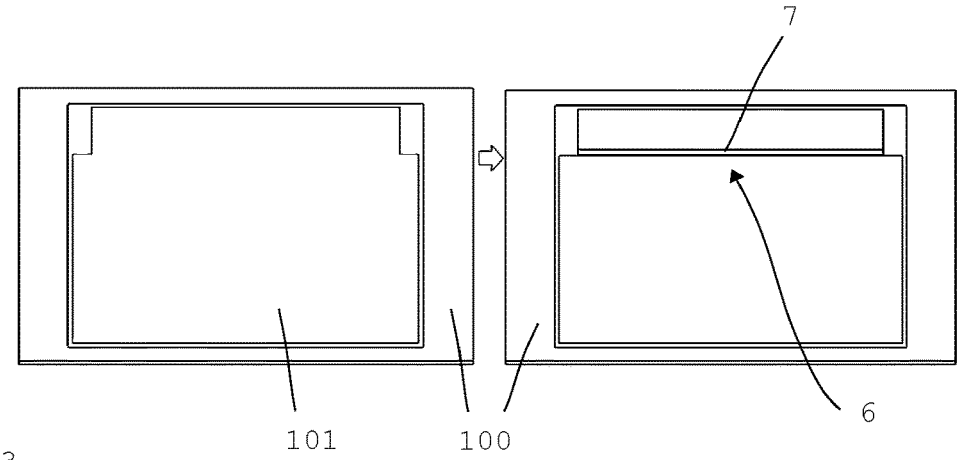
FIG. 3 shows purely schematically, in two top views, an exemplary embodiment of a cooking system according to the invention.

In FIG. 3, the installation of a cooktop system 200 according to the invention is shown purely schematically in two top views. The view on the left shows purely schematically that a common opening 101 is formed in countertop 100. In the exemplary embodiment shown, a milled recess or groove or rabbet is provided around opening 101, the milled recess or groove or rabbet being formed such that mounting frame 5 of downdraft ventilator 1 and cooktop device 50 terminate flush with the top surface of countertop 100.

The right-hand view of FIG. 3 shows purely schematically that downdraft ventilator 1, or housing device 2 of downdraft ventilator 1, is set into cabinet body 150, and that vapor-collecting hood device 3 engages into opening 101.

It can further be seen that a supporting device 6 having a supporting element 7 is provided to support the mounting frame 5 of downdraft ventilator 1, which supporting device 6 is mounted on housing device 2 of downdraft ventilator 1.

This supporting device 6 and supporting element 7 ensure that, despite a common opening 101 in countertop 100 for downdraft ventilator 1 and cooktop device 50, cooktop device 50 and downdraft ventilator 1, or mounting frame 5 of downdraft ventilator 1, are supported all around.

Figure 4:
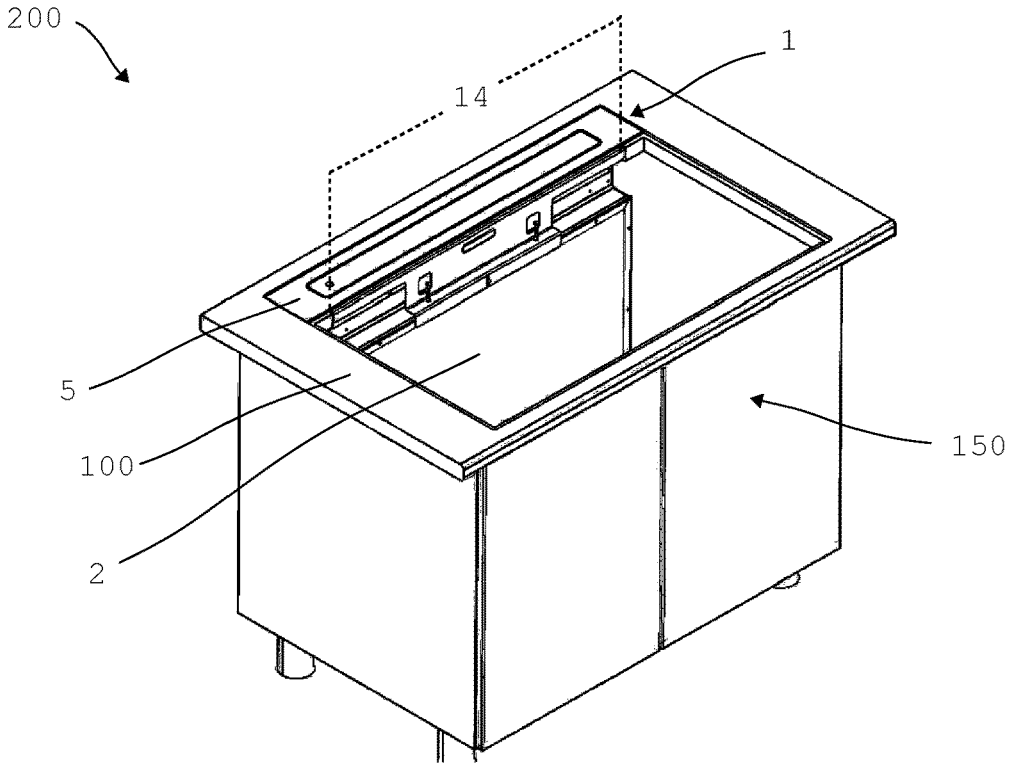
FIG. 4 shows purely schematically, in a perspective view, a further exemplary embodiment of an inventive cooking system including an inventive downdraft ventilator.

In FIG. 4, an exemplary embodiment of an inventive cooking system 200 including an inventive downdraft ventilator 1 is shown purely schematically in a purely schematic, oblique perspective top view. In the exemplary embodiment shown here, cooking system 200 includes, as already described herein, a countertop 100 on a cabinet body 150, the countertop 100 being provided with a common opening 101 for downdraft ventilator 1 and a cooktop device 50. In order to better illustrate the principle of operation of the invention, cooktop device 50 is not depicted in the view shown here.

In the view shown, downdraft ventilator 1, or housing device 2 of downdraft ventilator 1, is disposed in cabinet body 150 near or on the rear wall. To ensure a stable installation, housing device 2 may, for example, also be screwed to the rear wall of cabinet body 150 or otherwise secured thereto, depending on the particular design.

In the exemplary embodiment shown, downdraft ventilator 1 includes a movable vapor-collecting hood device 3. Here, when vapor-collecting hood device 3 is in a home position, it terminates flush with mounting frame 5 of downdraft ventilator 1. In the exemplary embodiment shown, the mounting frame, after installation also cooktop device 50, also terminates flush with the top surface of countertop 100.

During operation of downdraft ventilator 1, vapor-collecting hood device 3 moves upwardly out through an opening 15 in mounting frame 5 such that intake opening 4 of vapor-collecting hood device 3 is disposed at a height suitable for drawing in cooking vapors rising from cooktop device 50.

In order to ensure that mounting frame 5 of downdraft ventilator 1 and cooktop device 50 are supported substantially all around although only one common opening 101 without a strip 102 is provided for downdraft ventilator 1 and cooktop device 50, a supporting device 6 having a supporting element 7 is provided on housing device 2 of downdraft ventilator 1. This supporting element 7 complements the supporting seat for cooktop device 50 and the mounting frame 5 of the downdraft ventilator in the region of opening 101 where otherwise a strip 102 would be provided in countertop 100. Supporting element 7 may be perforated and/or have predetermined fracture points to achieve different lengths by, in particular manually, severing portions therefrom.

In order to provide adequate support, it may be provided for the length 14 of supporting element 7 to be adjustable. Depending on whether or not a standard opening having a standard width is provided, length adjustment may be useful and expedient. For this purpose, supporting element 7 may, for example, be telescopic. However, it is also possible to provide attachment elements or extensions of different lengths, which can be attached as needed.

Figure 5:
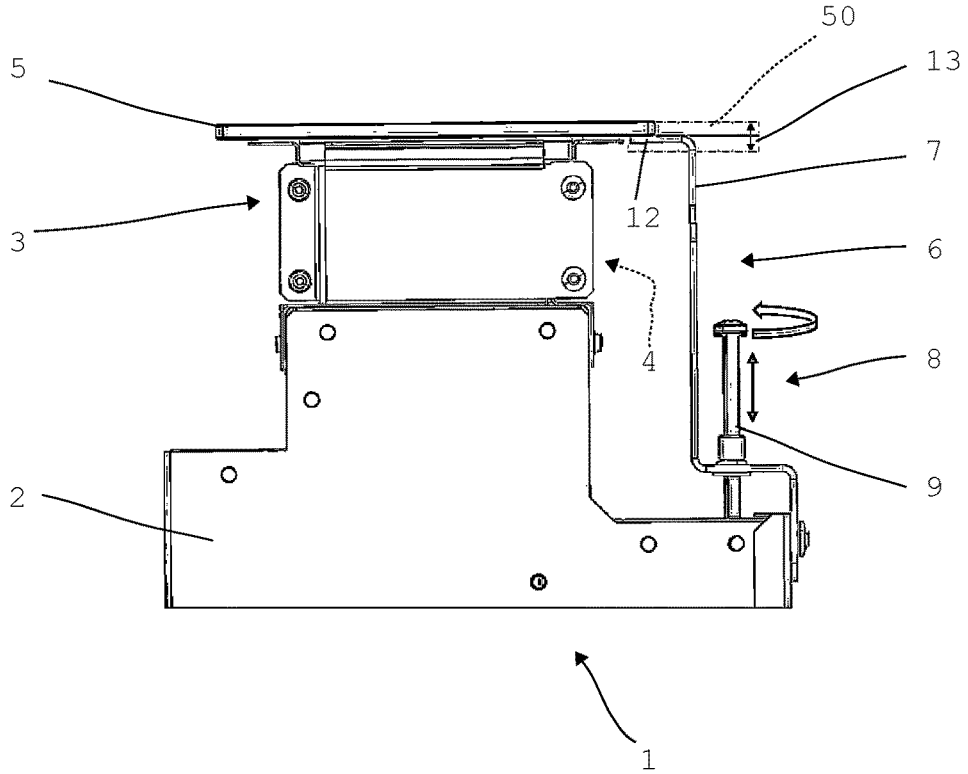
FIG. 5 shows a purely schematic side view illustrating the upper portion of the downdraft ventilator according to FIG. 4 in a side view.

In FIG. 5, downdraft ventilator 1 FIG. 4 is shown purely schematically in a schematic side view. Here, one knows housing device 2 of downdraft ventilator 1, which housing device 2 is disposed in cabinet body 51. Here, movable vapor-collecting hood device 3, which has an intake opening 4 toward cooktop device 50, sticks out of housing device 2.

In the view shown, it can be seen that in the exemplary embodiment shown, supporting device 6 is made of a sheet metal element 11. In the exemplary embodiment shown here, bearing portion 12 is bent over substantially into an L-shape. Depending on the particular design, a, for example, T-shaped bearing portion 12 may also be provided. Configuring bearing portion 12 in this manner enables supporting element 7 to support both mounting frame 5 of downdraft ventilator 1 and cooktop device 2.

To allow height 13 of supporting element 7 or of bearing portion 12 to be optimally adapted to the remaining supporting height, it is provided for supporting device 6 or supporting element 7 exemplary embodiment shown to be adjustable in height. For this purpose, in the exemplary embodiment shown here, supporting device 6 includes a height adjustment device 8. In the embodiment shown here, the adjustment of height 13 is accomplished by adjusting screws 9.

Figure 6:
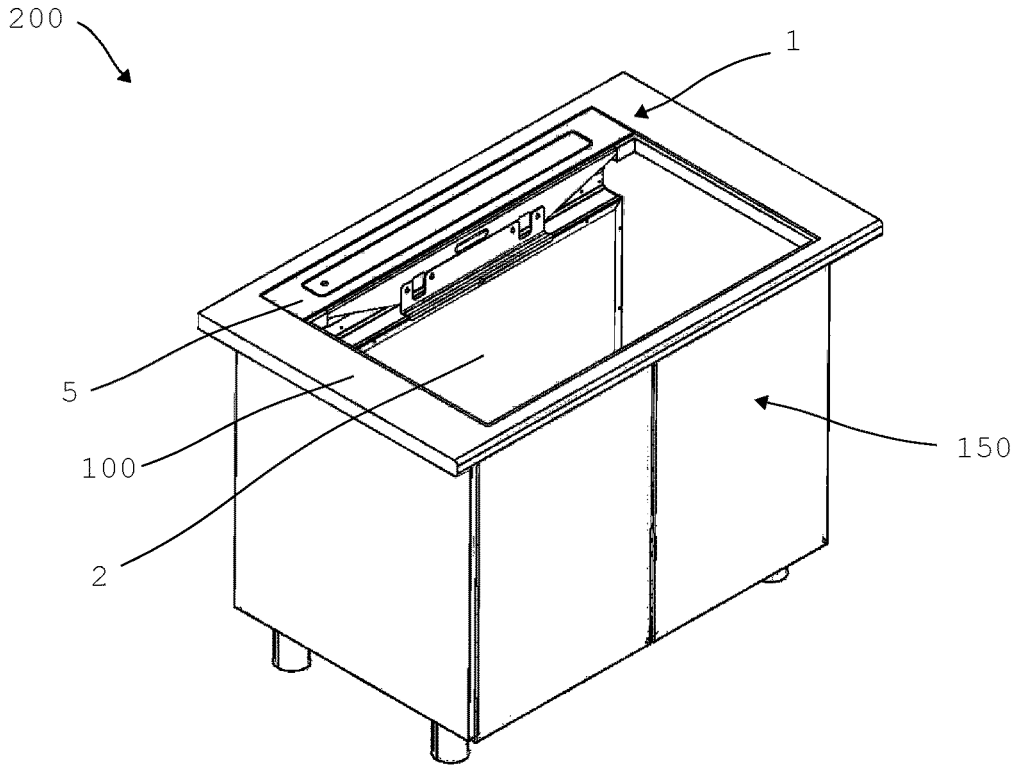
FIG. 6 shows purely schematically, in a perspective view, a next exemplary embodiment of an inventive cooking system including a downdraft ventilator according to the invention.
Figure 7:
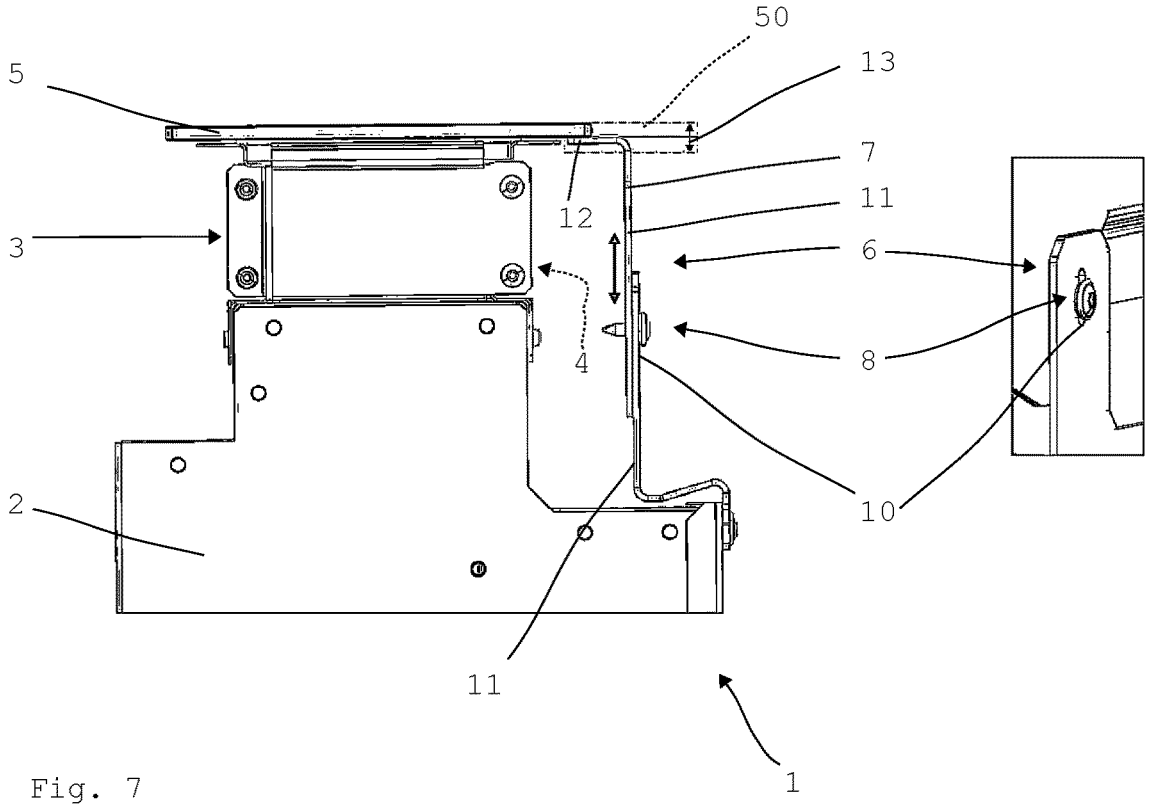
FIG. 7 shows a purely schematic side view illustrating the upper portion of the downdraft ventilator according to FIG. 4 in a side view.

In FIGS. 6 and 7, there is shown another exemplary embodiment of a cooking system 200 according to the invention. This exemplary embodiment corresponds substantially to the previously illustrated exemplary embodiment according to FIGS. 4 and 5.

In contrast to the previously illustrated exemplary embodiment, in the exemplary embodiment shown here, height adjustment device 8 includes two relatively movable sheet metal elements 11, the height adjustment for optimal adaptation of height 13 of supporting element 7 or of bearing portion 11 being provided by elongated slots 10. This allows for optimal adjustment of height 13 of supporting element 7 or of the bearing portion.

However, depending on the particular design, other height adjustment device 8 may also be used, such as at least one eccentric cam. It is also possible that components from individual exemplary embodiments may be combined. For example, it is in particular possible that even if adjusting screws 9 are used for height adjustment device 8, supporting device 6 may be attached to housing device 2 is via a slot guide so that operation of adjusting screws 9 causes supporting device 6 or supporting element 7 to be moved up or down in a guided manner.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 downdraft ventilator
2 housing device
3 vapor-collecting hood device
4 intake opening
5 mounting frame
6 supporting device
7 supporting element
8 height adjustment device
9 adjusting screw
10 elongated slot
11 sheet metal element
12 bearing portion
13 height
14 length
15 opening
50 cooktop device
100 countertop
101 opening
102 strip
150 cabinet body
200 cooking system

The invention claimed is:

1. A downdraft ventilator, comprising:

at least one housing device for installation into at least one cabinet body below at least one countertop;

at least one vapor-collecting hood device having at least one intake opening for cooking vapors, and, when installed, the at least one vapor-collecting hood device at least partially extends through at least one opening in the at least one countertop;

at least one mounting frame fittable into the at least one opening of the at least one countertop, the at least one mounting frame having at least one opening for the vapor-collecting hood device; and at least one supporting device having at least one supporting element, the at least one supporting device being mounted on the at least one housing device, and the at least one supporting element being configured to cause the at least one mounting frame and/or at least one cooktop device disposed adjacent thereto to be supported at least in some portions, the at least one supporting device including at least one height adjustment device, wherein a length of the at least one supporting element is adjustable.

2. The downdraft ventilator of claim 1, wherein the at least one vapor-collecting hood device is at least partially movable.

3. The downdraft ventilator of claim 2, wherein the at least one height adjustment device includes at least one adjusting screw, at least one elongated slot, and/or at least one eccentric cam.

4. The downdraft ventilator of claim 1, wherein the at least one supporting element comprises at least one sheet metal element.

5. The downdraft ventilator of claim 1, wherein the at least one supporting element includes a bearing portion which is substantially L-shaped and/or T-shaped, at least in some portions.

6. A cooking system, comprising:

the downdraft ventilator of claim 1;

the at least one countertop;

the at least one cabinet body;

the at least one cooktop device; and wherein the at least the housing device is disposed in the at least one cabinet body, wherein the at least one countertop has a common opening for the at least one vapor-collecting hood device and for the at least one cooktop device, and wherein at least some portions of the at least one mounting frame and/or of the at least one cooktop device rest on the at least one supporting element of the at least one supporting device.

7. The cooking system of claim 6, wherein the at least one mounting frame and the at least one cooktop device are disposed flush against each other.

8. A method for installing the cooking system of claim 7, comprising:

making the common opening for the at least one vapor-collecting hood device and for the at least one cooktop device in the at least one countertop;

installing the at least one housing device in the at least one cabinet body;

installing the at least one supporting device on the at least one housing device; and installing the at least one mounting frame and the at least one cooktop device, with a height of the at least one supporting element being adjusted by the at least one height adjustment device.

9. The method of claim 8, further comprising:

adjusting a length of the at least one supporting element.

10. A method for installing a cooking system, the cooking system comprising: at least one housing device for installation into at least one cabinet body below at least one countertop; at least one vapor-collecting hood device having at least one intake opening for cooking vapors, and, when installed, the at least one vapor-collecting hood device at least partially extends through at least one opening in the at least one countertop; at least one mounting frame fittable into the at least one opening of the at least one countertop, the at least one mounting frame having at least one opening for the vapor-collecting hood device; and at least one supporting device having at least one supporting element, the at least one supporting device being mounted on the at least one housing device, and the at least one supporting element being configured to cause the at least one mounting frame and/or at least one cooktop device disposed adjacent thereto to be supported at least in some portions, the at least one supporting device including at least one height adjustment device, wherein the at least the housing device is disposed in the at least one cabinet body, wherein the at least one countertop has a common opening for the at least one vapor-collecting hood device and for the at least one cooktop device, wherein at least some portions of the at least one mounting and/or of the at least one cooktop device rest on the at least one supporting element of the at least one supporting device, and wherein the at least one mounting frame and the at least one cooktop device are disposed flush against each other, the method comprising:

making the common opening for the at least one vapor-collecting hood device and for the at least one cooktop device in the at least one countertop;

installing the at least one housing device in the at least one cabinet body; installing the at least one supporting device on the at least one housing device; and installing the at least one mounting frame and the at least one cooktop device, with a length of the at least one supporting element being adjusted by the at least one height adjustment device.

* * * * *